United States Patent [19]

Cammack et al.

[11] 4,309,783

[45] Jan. 12, 1982

[54] ADJUSTABLY CONFORMABLE BED

[75] Inventors: Michael A. Cammack; Keith M. Mullins, both of Ft. Collins, Colo.

[73] Assignee: Teledyne Industries, Inc., Ft. Collins, Colo.

[21] Appl. No.: 119,193

[22] Filed: Feb. 6, 1980

[51] Int. Cl.[3] ..... A47C 21/06; A61G 7/00; A61G 7/06

[52] U.S. Cl. ..... 5/508; 5/66; 5/68

[58] Field of Search ..... 5/66, 68, 458, 496, 5/498, 508

[56] References Cited

U.S. PATENT DOCUMENTS

| | | | |
|---|---|---|---|
| 388,037 | 8/1888 | Hargin | 5/458 |
| 1,627,835 | 5/1927 | Combs | 5/458 |
| 2,016,054 | 10/1935 | Sentell | 5/458 |
| 2,450,699 | 10/1948 | Veach | 5/458 |
| 2,769,182 | 11/1956 | Nunlist | 5/68 |
| 3,245,092 | 4/1966 | Kreuz | 5/68 |
| 3,392,412 | 7/1968 | Aymar | 5/68 X |
| 3,477,071 | 11/1969 | Emerson | 5/61 |
| 3,606,623 | 9/1971 | Aymar | 5/68 X |
| 3,636,573 | 1/1972 | Bartz | 5/68 |
| 3,781,928 | 1/1974 | Swallert | 5/68 |
| 3,879,772 | 4/1975 | Pol | 5/68 |
| 3,965,504 | 6/1976 | Ainsworth | 5/496 |
| 4,188,677 | 2/1980 | Zuv | 5/68 |

*Primary Examiner*—James T. McCall
*Attorney, Agent, or Firm*—Hugh H. Drake

[57] ABSTRACT

To be situated between a mattress and a box spring is a hinged frame that includes inflatable bags located respectively beneath the head and foot portions of the mattress. A controlled pump unit permits selective inflating of the bags so as individually to elevate the different portions of the mattress at the command of a user. Construction features of one version include internal contour-defining elements tied between space-opposed supports affixed to the walls of the bags and double-plate supports readily mounted into the bags and which enable tying of the bags to the frame. Another version uses an arrangement of straps to define contour.

32 Claims, 40 Drawing Figures

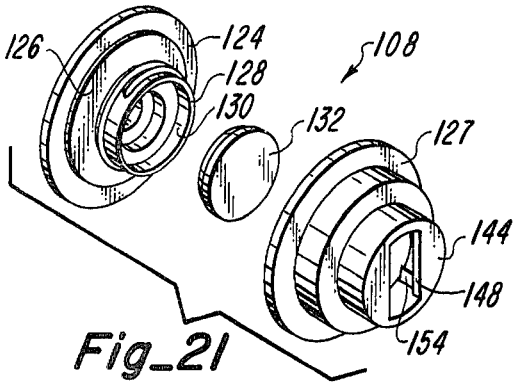
Fig_21
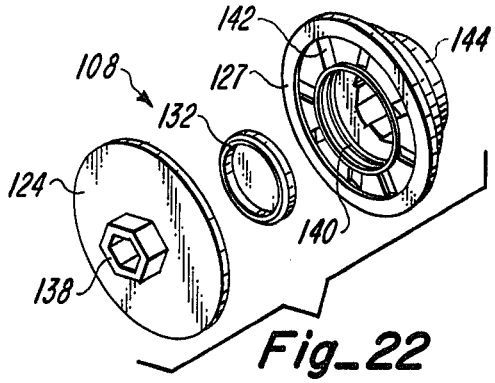
Fig_22
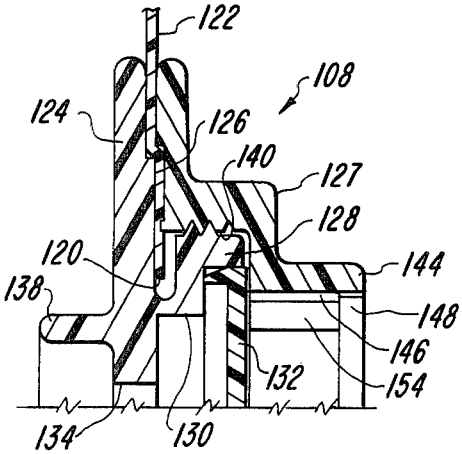
Fig_23
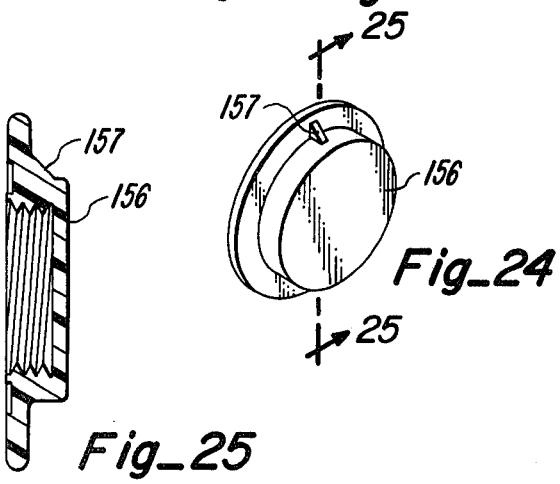
Fig_24
Fig_25
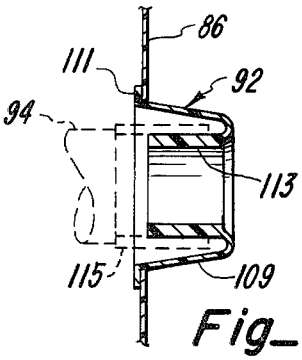
Fig_26

ADJUSTABLY CONFORMABLE BED

The present invention pertains generally to a bed in which the head and foot portions are adjustable to different degrees of elevation. More particularly, it relates to apparatus beneath the mattress or pad for raising or lowering different portions of the bed so as to accommodate the needs or desires of the user.

What may be called adjustable beds are well known and have existed in many forms. Particularly for use in hospitals or convalescent homes, supporting frames have been devised which enable elevation in selective degrees of different portions of a mattress. While various mechanical arrangements have been devised to accomplish adjustability in the conformation of a flexible mattress, one particularly attractive prior approach has involved the use of inflatable bags placed beneath the mattress and expandable so as to cause the elevation of different portions thereof. Believed to be representative of the state of the art are the following U.S. Pat. Nos.

2,769,182—Nunlist
3,392,412—Aymar
3,477,071—Emerson
3,606,623—Aymar
3,781,928—Swallert
3,879,772—Pol In general, the prior art as represented by the aforelisted patents has enabled the achievement of the desired adjustment in orientation of different portions of an overlying mattress. Unfortunately, such approaches have been deficient in one or more respects. Those that have enabled a user to have a rather wide degree in the flexibility and selection of ultimate mattress conformation have proved to be sufficiently costly to restrict their normal availability to hospitals or similar usage. That portion of the prior art which has made use of inflatable bladders or bags has involved structures which tend to become expensive in manufacture or which involve the use of components that either are structurally weak or are substantially difficult of installation.

A general object of the present invention is to provide a new and improved adjustable support that overcomes deficiencies in generally similar apparatus such as that described above.

Another object of the present invention is to provide an adjustable support which affords a high degree of flexibility of adjustment while yet being simple and economical of manufacture.

A further object of the present invention is to provide a new and improved adjustable support that is capable of being supplied in a form that minimizes problems in shipping and handling.

It is an additional object of the present invention to provide a new and improved adjustable support adaptable for use with an ordinary and conventional mattress.

Still another object of the present invention is to provide a new and improved adjustable support that may be easily and conveniently stocked in stores and delivered to the user and yet which is readily installable by a user who happens to have minimal mechanical experience.

A still further object of the present invention is to provide a new and improved adjustable support that is in itself light in weight and yet which is capable of presenting to the underside of a mattress or the like the forces necessary to achieve selective flexing of that mattress.

It is yet another object of the present invention to provide a new and improved adjustable support that employs only components that are easily serviced and in which a failure of any component results only in the necessity of replacement of that particular portion of the overall assembly.

The invention is thus concerned with a flexible pad, such as the mattress, that overlies a supporting substrate which typically would be a box spring. The apparatus includes the features of flexural adjustability of the pad to a plurality of different positions. Included in the apparatus is at least one and preferably a pair of inflatable bags specifically shaped to be positioned between the pad and the substrate as well as means for inflating the bags. In one aspect of the invention, there is at least one elongated contour-defining element disposed within such a bag. A pair of supports are individually affixed to space-opposed portions of the bag and individually secured to respective opposite ends of the element. The element is of a length to limit expansion of the bag between such portions. Another inventive feature involves the formation of such a support in the form of first and second plates each sized to overlie an opening in the wall of the bag, together with means included in those plates so as to enable sealing of the plates around the margin of the opening. Numerous other detailed features are presented with respect to this version. In addition, an alternative approach features contour-defining flexible straps which encircle the bag and are secured with respect to an associated hinged frame that overlies the bag and supports a portion of the mattress.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

FIG. 9 is an enlarged cross-sectional view taken along the line 9—9 in FIG. 8;

FIG. 21 is an exploded isometric view of a portion of the assemblage shown in FIG. 12;

FIG. 22 is an exploded isometric view of the same elements as shown in FIG. 21 but taken from a different angle;

FIG. 23 is a fragmentary cross-sectional view of the apparatus of FIGS. 21 and 22 as assembled in the manner shown in FIG. 12;

FIG. 24 is an isometric view of an alternative for a component that is shown in FIGS. 21 and 22;

FIG. 25 is a cross-sectional view taken along the line 25—25 in FIG. 24;

FIG. 26 is an enlarged cross-sectional view taken along the line 26—26 in FIG. 17;

Figure 1:
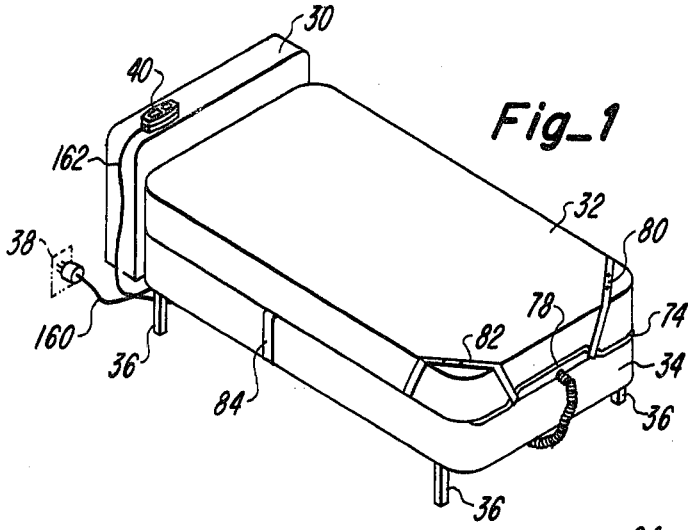
FIG. 1 is an isometric view of a complete bed assembly within which adjustable conformation means are included.

A typical bed assembly as illustrated in FIG. 1 includes a headboard 30, a mattress or pad 32 and an underlying box spring or substrate 34. In contemplation of what is to follow, headboard 30 is not necessarily included, mattress 32 may be any kind of covering pad and box spring 34 could be represented by any kind of underlying substrate such as that presented by the floor of the room in which the apparatus is situated. In this case, however, box spring 34 is shown as to include downwardly projecting legs 36 which normally support the box spring above the floor. In a conventional alternative, the entire assemblage may be mounted within the frame of an ordinary bedstead which has its own legs for support from the floor. Also illustrated in FIG. 1 are a conventional wall receptacle 38 to which a unit to be described may be connected for the receipt of operating electrical power and control unit 40 that enables operation in a manner that will be further described.

Figure 10:
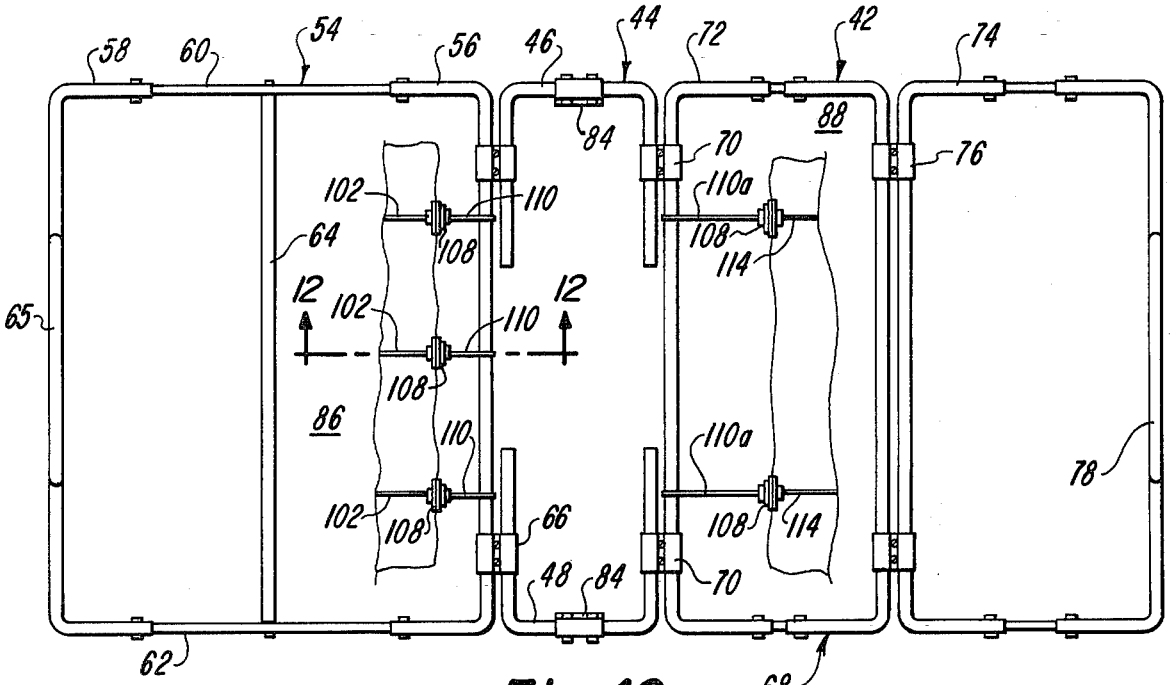
FIG. 10 is an enlarged plan view of the frame which is shown in FIG. 3 together with a fragmentary showing of other apparatus associated therewith.
Figure 11:
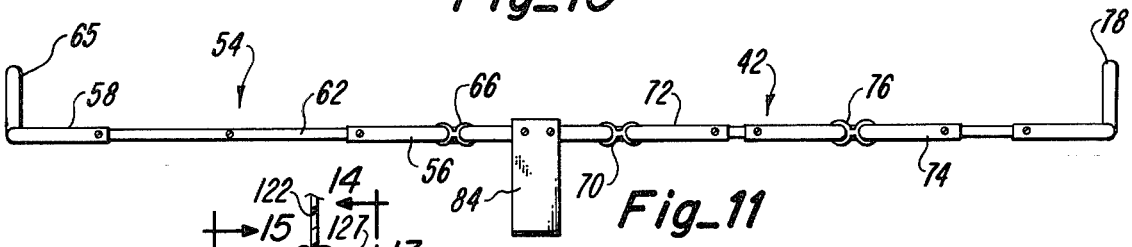
FIG. 11 is a side elevational view of the frame as shown in FIG. 10.
Figure 28:
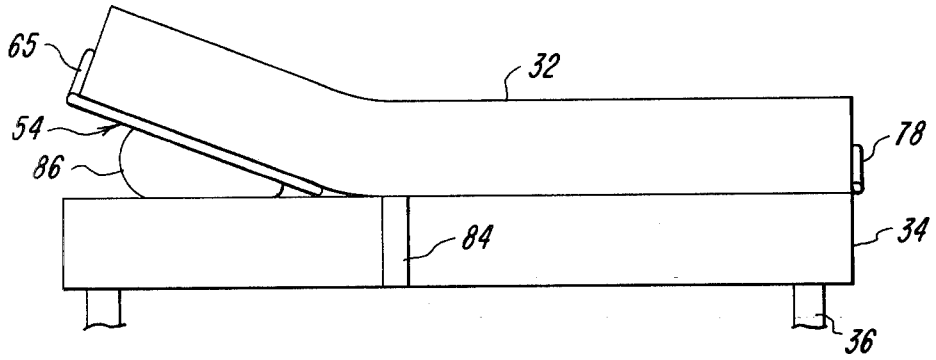
FIG. 28 is a schematic side elevational view similar to FIG. 27 but showing a variation in conformation of components thereof.
Figure 29:
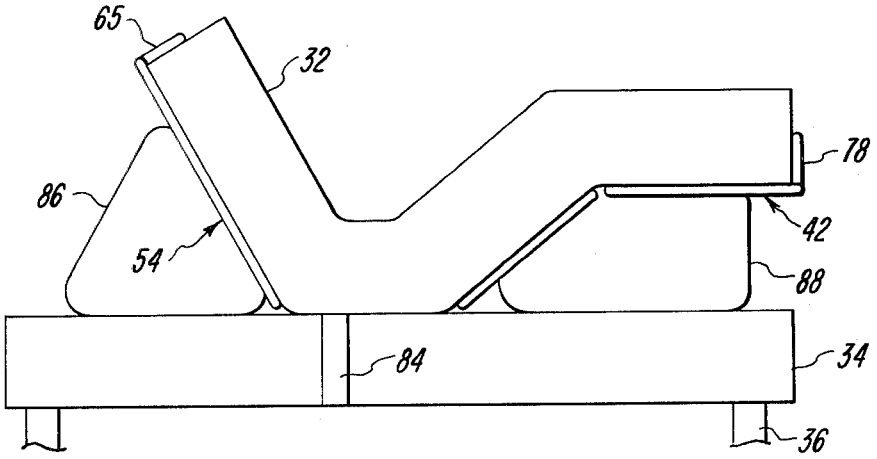
FIG. 29 is also a schematic side elevational view depicting a still different conformation from that which is shown in FIGS. 27 and 28.
Figure 30:
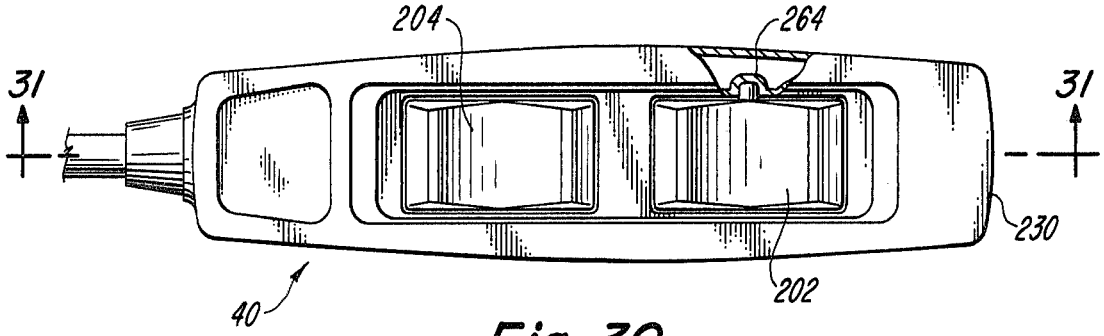
FIG. 30 is a plan view of a component shown in FIG. 7.

Sandwiched between pad 32 and substrate 34 is a frame assembly 42. Assembly 42 includes a central section 44 which in this case is formed of laterally-facing U-shaped portions 46 and 48. Adjacent to one side of central section 44 is a first end section 54. As illustrated, section 54 is composed of a pair of mutually facing U-shaped elements 56 and 58 that are joined together rigidly by corresponding struts 60 and 62. A lateral cross-strut 64, fastened between struts 60 and 62, adds rigidity to end section 54 and central support for the overlying pad. Preferably included in segment 58 is an upwardly-deformed central end portion 65 that functions to restrain longitudinal movement of one end of rectangular mattress or pad 32. The bight of segment 56 is swingably affixed to the adjacent margin of central section 44 by a pair of hinges 66. As shown in FIG. 10, each hinge 66 includes facing upper and lower plates that are fastenable together about the tubular walls of the sections concerned and include C-shaped fingers which fit about those tubular walls. As a result, end section 54 may be swung upwardly from the horizontal to an elevated position of varying degree of elevation as shown in FIGS. 28 and 29.

Another end section 68 is similarly formed of rigid tubing and is joined to central section 44 at hinges 70 formed in the same manner as hinges 66. As before, end section 68 is constructed of variously-mating tubular elements that are capable of being joined together in order to complete the desired assembly. In this case, however, end section 68 is formed of two successive subsections 72 and 74, subsection 72 being joined at hinge 70 to central section 44 and subsection 74, in turn, being hingedly joined at 76 to subsection 72. The outer end portion of section 74 also includes a raised section 78 which serves in use to confine the bottom end of mattress 32 into position.

As so far illustrated, hinges 66, 70 and 76 each are simply composed of a pair of mutually facing plates clamped together by screws and which include outwardly directed oppositely facing concave surfaces which captivate the associated tubular elements of the members of the frame section. An improved hinge structure is described hereinafter.

Further associating frame 42 with mattress 32 and box spring 34 are various straps that serve to confine the frame in place beneath the mattress. For example, and as shown in FIG. 1, straps 80 and 82 serve to tie the foot end of mattress 32 to subsection 74. A pair of L-shaped brackets 84 secure central section 44 of the frame to box spring 34. As shown, the upper end portion of each leg is affixed to the bight of a corresponding one of frame portions 46 and 48. The foot of each bracket projects inwardly beneath box spring 34. In other adaptations, brackets 84 may take whatever form is suitable for preferred fastening to any particular underlying substrate.

Disposed on top of box spring 34 but beneath main frame 42 is a first inflatable bag or bladder 86 of triangular cross-sectional area and located toward the head portion of the bed. Also on top of box spring 34 and again beneath frame 42 is another inflatable bag or bladder 88 which is generally rectangular in cross-sectional area but does have a sloping wall 90 facing central section 44. Bag 86 has an inlet 92 to which is coupled a hose 94 which leads to an air pumping unit 96. Similarly, bag 88 has an inlet 98 to which is coupled a flexible hose 100 that also is connected to air pump unit 96. While bags 86 and 88 may be constructed of any suitable bladder material, such as rubber or rubberized canvas, they perferably are made of reinforced vinyl.

Disposed inside bag 86 are three laterally-distributed flexible elements 102 each of which extends from an apex of the triangular shape to a space-opposed base of the triangular formation. Also in bag 86 is another flexible element 104 that extends between opposing side or marginal walls of the bag. Flexible elements 102 and 104 preferably are of nylon and have specific lengths critically selected to limit expansion of the bag between the portions thereof connected by the elements. Effecting that connection are a corresponding plurality of supports 106 and 108.

As shown in FIG. 26, coupling 92, to which hose 94 is joined, is formed of a hub 109 that has a peripheral margin 111 heat sealed to the wall of bag 86 and further includes a reentrant boss 113 upon which a sleeve 115 on the end of hose 94 is frictionally seated. Coupling 98 for hose 100 that connects to bag 88 is constructed in the same manner.

Supports 106 each serve as anchors for respective ends of the different ones of flexible elements 102 and 104. Supports 108 also serve as anchors for the respective ends of flexible elements 102 as connected thereto at the apex of the triangular cross-section of bag 86 and to the apex of bag 88 at the lower end of wall 90. Each of supports 108, however, is externally coupled to a tie rod 110 or 110*a*.

Bag 88 is similarly provided with a lateral flexible element 112 extending between respective supports 106 located centrally in its sidewalls. A spaced plurality of flexible elements 114 are each coupled between a support 106 in one wall and a support 108 at the bottom of space-opposed wall 90 that faces central section 44. A laterally-spaced still additional plurality of flexible elements 116 are coupled between respective ones of supports 106 in the corresponding top and bottom walls of bag 88.

Each of the flexible elements is of a specific length which limits expansion of the inflatable bags at the points of connection thereto. The flexible elements serve to reinforce maintenance of the general shape of the respective bags and also tend to cause its external surface to exhibit a tufted appearance.

Figure 12:
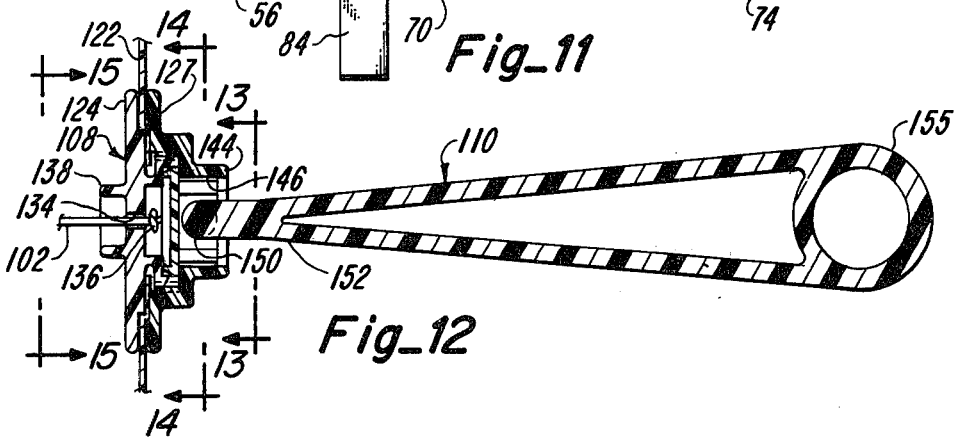
FIG. 12 is an enlarged fragmentary cross-sectional view taken along the line 12—12 in FIG. 10.
Figure 13:
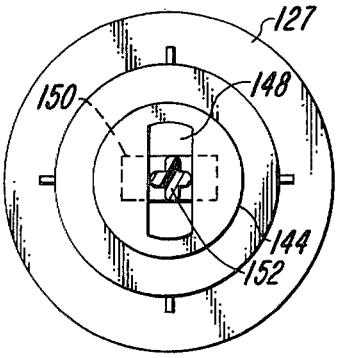
FIG. 13 is an enlarged cross-sectional view taken along the line 13—13 in FIG. 12.
Figure 15:
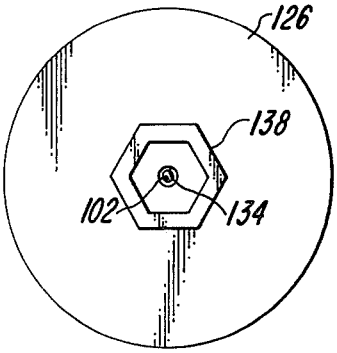
FIG. 15 is an enlarged fragmentary cross-sectional view taken along the line 15—15 in FIG. 12.
Figure 14:
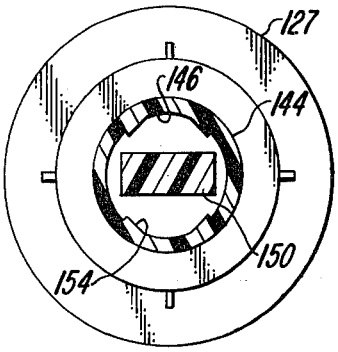
FIG. 14 is an enlarged cross-sectional view taken along the line 14—14 in FIG. 12.

As shown in detail in FIGS. 12 and 23, each of couplings 108 is mounted within an opening 120 cut into a wall 122 at the points indicated for each of bags 86 and 88. Couplings 108 are each composed of an inner plate 124 and an outer plate 127. On the interior side of plate 124 is a shallow boss 126 from which projects an externally-threaded stud 128 which is hollow so as to define a cavity 130. Closing cavity 130 is a frictionally-seated cap 132. Centrally disposed within plate 124 and communicating with cavity 130 is an opening 134 through which an end portion of the corresponding flexible element, such as 102, extends and then is knotted as indicated at 136 in FIG. 12 so as to be secured within cavity 130.

Projecting away from the exterior surface of plate 124 is a hollow nut 138 that surrounds opening 134. Upon installation of support 108, and with the inflatable bag under a condition of non-inflation, nut 138 may be grasped through coupling 92 as to enable the tightening of the other plate 127 into place. That other plate 127 includes an internally threaded bore 140 which mates with stud 128, so as to enable plate 127 to be screwed toward plate 124 and tighten the respective marginal flanges toward one another and seal the wall margin around opening 120. Radial cleats 142, on the surface of plate 127 that faces wall 122 of the bag, assist in molding the internal threads.

Projecting outwardly from plate 127 is a hub 144 that defines an internal cavity 146 and presents an outwardly facing slot 148. A trunnion 150 on one end of the bifurcated shank 152 of each tie 110 or 110*a* is sized to be received within slot 148. Upon then rotating shank 152 by ninety degrees, trunnion 150 becomes captivated within cavity 146. Moreover, lugs 154, spaced around the sidewalls of cavity 146, serve to restrain trunnion 150 from turning movement and ultimate escape from cavity 146. Cap 132 serves upon assembly to confine the ends of trunnion 150 against escape and also serves as an air-sealing piston.

Figure 19:
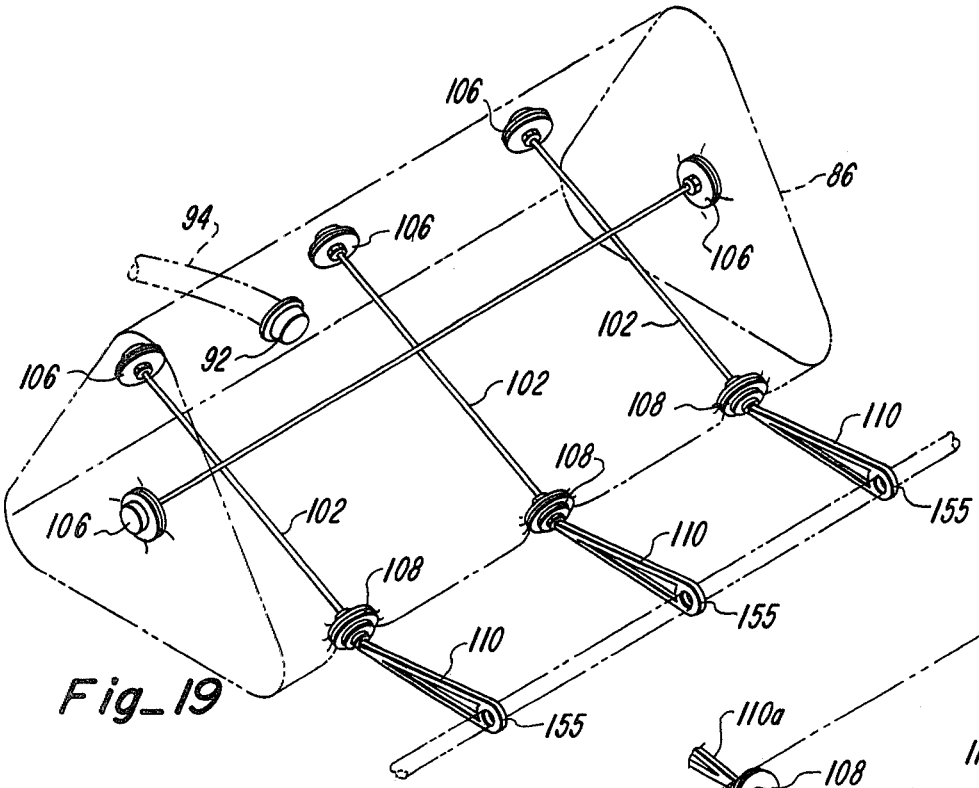
FIG. 19 is an enlarged isometric view, similar to FIG. 4 but illustrating components associated therewith in increased detail.
Figure 20:
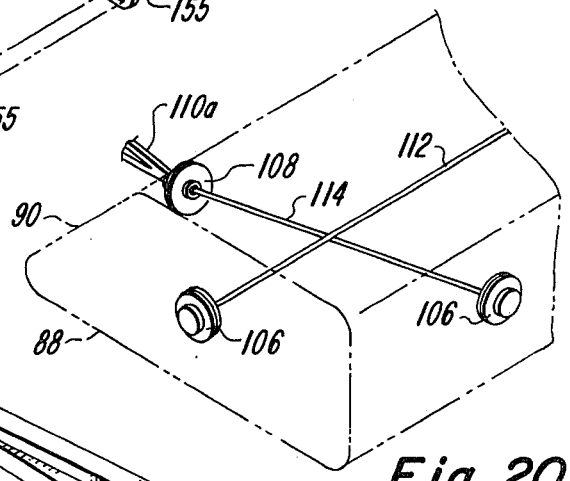
FIG. 20 is analogously an enlarged and fragmentary isometric view similar to FIG. 5 but also showing various components in more detail.
Figure 17:
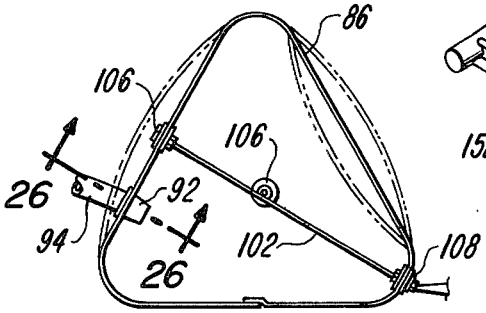
FIG. 17 is an enlarged cross-sectional view taken along the line 17—17 in FIG. 4.
Figure 16:
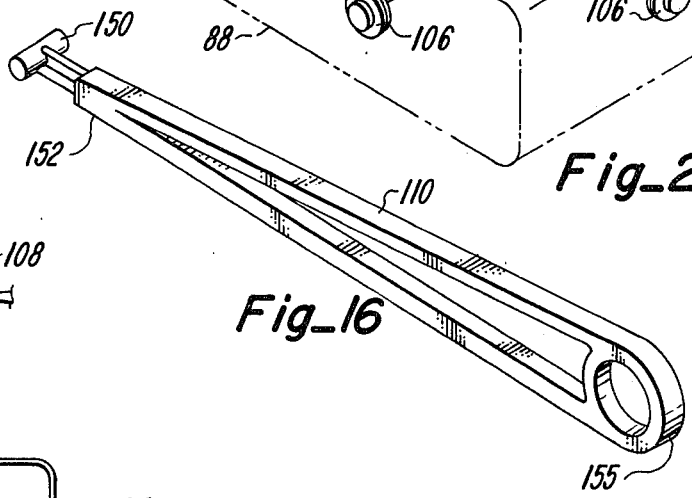
FIG. 16 is an isometric view of a component shown in FIG. 12.
Figure 18:
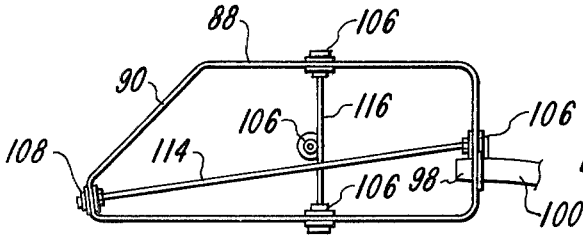
FIG. 18 is an enlarged cross-sectional view taken along the line 18—18 in FIG. 5.

At the other end of shank 152 of tie 110 or 110*a* is a circular bearing 155. As perhaps best illustrated in FIGS. 10 and 19, bearing 155 on each of ties 110 is swingable around the adjacent portion of a frame member. It will be observed that supports 108 enable manually-releasable and yet pivotal coupling to corresponding one ends of each of ties 110 and 110*a*. At the same time, bearings 155 permit a swinging movement of those ties. Still further, it also will be observed that supports 108 are affixed respectively to bags 86 and 88 only along the side thereof which faces central section 44 of frame 42. The only basic difference between ties 110 and 110*a* is that, for the particular frame arrangement illustrated, ties 110 preferably have an overall length which is less than that of ties 110*a*.

Couplings 106, which are not connected to an external tie, are similar to couplings 108 except that they do not need to have cap 132 or cover plate 127 and its slot 148 which accepts trunnions 150. Instead, couplings 106 still employ plate 124 but their part which is external to the associated air bag is only an internally threaded cap 156 as shown in FIGS. 24 and 25. Of course, cap 156 threads onto boss 128 of plate 124 so as to effect a seal around a margin of an opening 120. Exposed lugs 157 assist by providing a better grasp for tightening.

Pump unit 96 is connectable by a cord 160 to a conventional electric outlet and by another cord 162 to control 40. The pump unit includes an overall housing 164, to be further described in more detail, that has a circumferential vent 166 for communication with the external atmosphere. Preferably, an annular air filter 168 is disposed immediately inside vent 166. Supported within housing 164 is an electric motor 170 which drives a centrifugal blower or fan 172. Upon energization of the motor to rotate the blower, air is drawn through vent 166 so as to develop a positive pressure within housing 164. Hoses 94 and 100 are affixedly coupled respectively into outlets 174 and 176 that exist in housing 164.

Forming a part of outlet 176 is a valve seat 178 for a valve 180 urged by a spring 182 toward a normally-closed position; for illustration, valve 180 is shown in its "open" position. Affixed to valve 180 is a plunger 184 slidable within a solenoid coil 186 which is energizable to open the valve. Valve 180 is coupled to plunger 184 by means which includes a valve stem 188. Air flow is enabled through passages 189. In the same manner, outlet 174 includes a valve 190 engageable with a valve seat 192, communicating with air passages 193, and including a shank or stem 194 coupled to a plunger 196 slidable within a solenoid coil 198, the valve being biased to a normally-closed position by a spring 200.

Control 40 desirably has two double-acting rocker buttons 202 and 204 associated respectively with the valves in outlets 174 and 176, although other switches may be used. Upon depression of rocker button 202 in one direction, for example, motor 170 is energized at the same time that the valve in outlet 174 is opened, allowing air to be delivered to air bag 86 through hose 94 so as to inflate that air bag. On the other hand, rocker button 202 may be rocked in the opposite direction so as to again open the valve in outlet 174 but not energize motor 170. This mode of operation enables air to flow out of bag 86 so that it deflates. In the same manner, rocker button 204 may be rocked in one direction to both open the valve associated with outlet 176 and energize motor 170 for the purpose of inflating bag 88. Conversely, button 204 may be rocked in the other direction so as only to open that valve and enable a deflating of bag 88 to occur.

Figure 27:
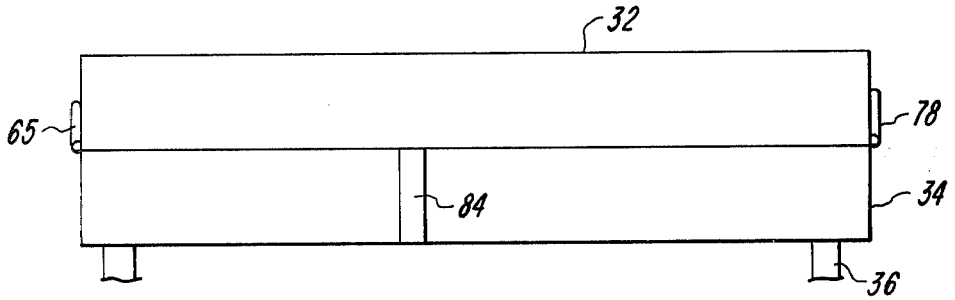
FIG. 27 is an enlarged schematic side elevational view of a basic portion of that which is shown in FIG. 1.

FIGS. 27–29 are illustrative of but a few of the possible modes of operation of the entire assemblage. In FIG. 27, bags 86 and 88 are entirely deflated, so that mattress 32 lies in its ordinary or normal position on box spring 34. As shown in FIG. 28, air bag 86, near the head of the bed, has been partially inflated so as to raise the head end of mattress 32 a partial amount. As shown in FIG. 29, however, both air bags 86 and 88 have been fully inflated. In this case, the head end of mattress 32 is in a near upright condition, while the foot end of mattress 32 has been elevated and also articulated by reason of the shape of bag 88 and the provision of hinges 70 and 76. Of course, the user may operate control 40 so as to achieve any of an infinite variety of other modes in the ultimate positioning of mattress 32.

It will be observed that the entire unit is capable of being boxed and shipped in cartons acceptable to commercial or governmental carriers or by other means. While the totality of the apparatus is rather light in weight, it still is capable of performing its task in a manner at least equivalent to much heavier and more expensive hospital-type units that heretofore have been developed for a similar purpose. Economy is enhanced by the use of some like components for different purposes. Residual strength is imparted to the active elements by means which are economical of production and assembly.

Figure 6:
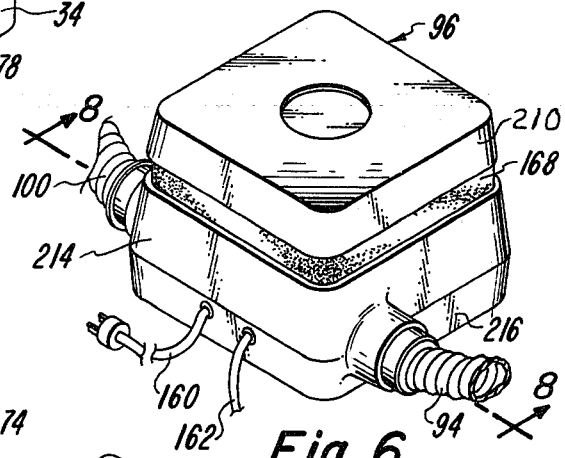
FIG. 6 is an enlarged fragmentary isometric view of a component shown in FIG. 2.
Figure 3:
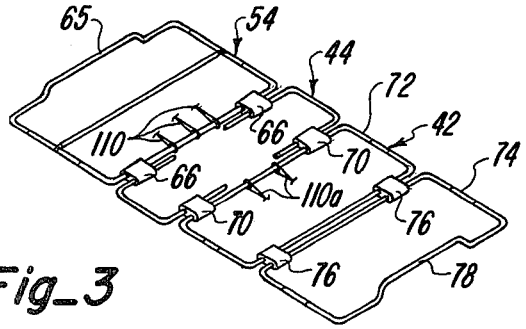
FIG. 3 is an isometric view of a frame assembly included within the apparatus of FIGS. 1 and 2 and including a fragmentary showing of certain connecting elements.
Figure 7:
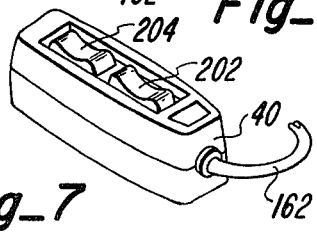
FIG. 7 is an enlarged isometric view of another component shown in FIGS. 1 and 2.
Figure 8:
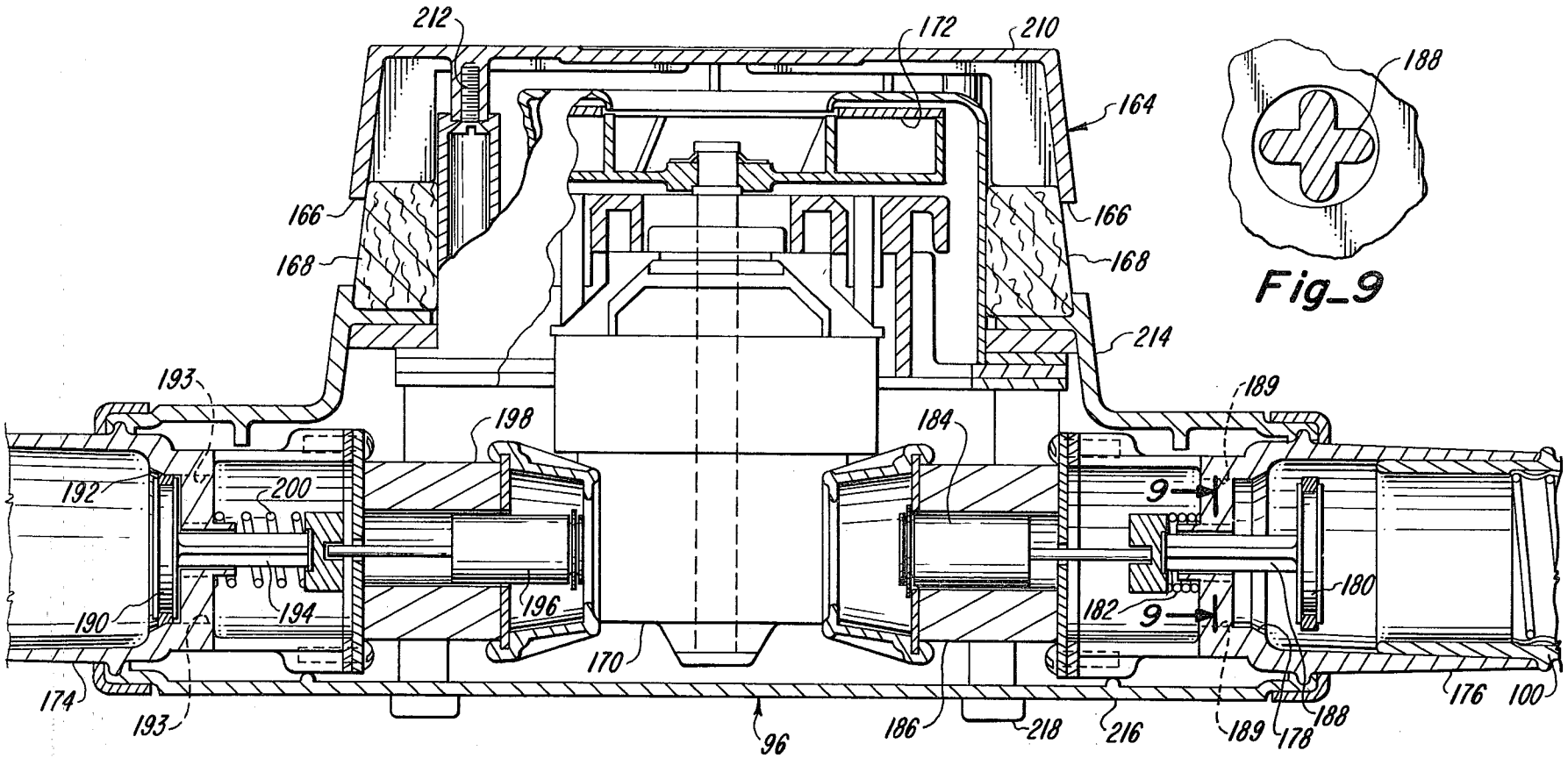
FIG. 8 is an enlarged cross-sectional view taken along the line 8—8 in FIG. 6.

Having discussed the basic features of a principal embodiment, attention is now directed to additional features and further ramifications. Directing attention first to FIGS. 6 and 8, it will be seen that overall housing 164 of pump unit 196 advantageously is composed of three different portions in an arrangement which leads to substantial economy in assembly. An upper cover 210 serves to shield the user from exposure to blower 172 and also defines a part of the wall which constitutes air-inlet opening 166. Cover 210 is affixed, as by screws 212, to an intermediate portion 214 to which, in turn, is suitably affixed a lower cover 216. Resilient feet 218 project beneath the bottom of lower cover 216. Lower cover 216 mates with intermediate portion 214 so as to define that which serve to constitute the air outlets and also to support the valving structure associated therewith and as previously described. This three-part arrangement of overall housing 164 is beneficial in enabling efficient assembly, during production, of the overall unit as well as in enabling service personnel subsequently to repair efficiently some part that might have failed.

Figure 31:
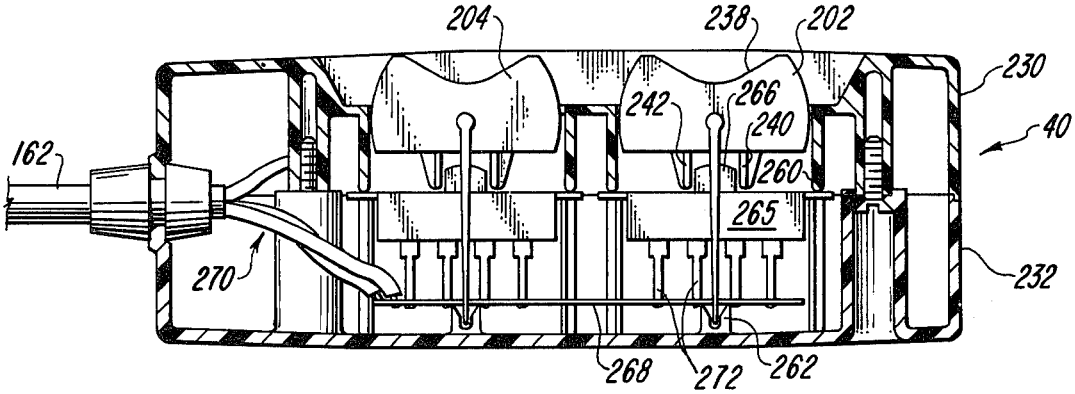
FIG. 31 is a cross sectional view taken along the line 31—31 in FIG. 30.
Figure 32:
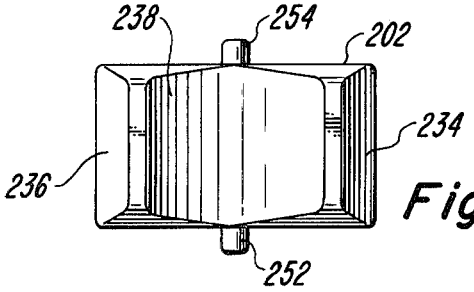
FIG. 32 is an enlarged plan view of a sub-component shown in FIGS. 30 and 31.
Figure 33:
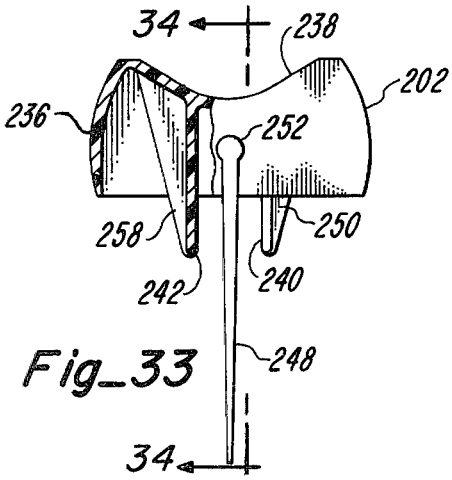
FIG. 33 is a side elevational view, partially broken away, of the sub-component shown in FIG. 33.
Figure 34:
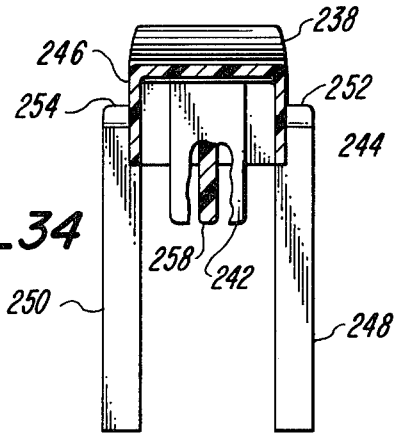
FIG. 34 is a cross-sectional view taken along the line 34—34 in FIG. 33 and partially broken away.

Again giving attention to control unit 40, and now with particular reference to FIGS. 30–34, attention is directed particularly to the apparatus which implements the operation of rocker buttons 202 and 204. While FIGS. 32–34 focus only upon one of those two rocker buttons, the approach is the same with respect to both. As shown in FIG. 31, control unit 40 has a housing which is composed of an upper part 230 and a lower part 232 that are mated together, by means of the illustrated screws, so as to accept rocker buttons 202 and 204 in a confined manner and enable mounting of the associated sub-components.

Thus, button 202 is of a generally rectangular shape as seen in a plan view and is molded into the form of a hollow shell open on its underside and having outwardly concave end walls 234 and 236 which merge into a depressed or convex upper wall 238. Projecting downwardly from within the interior of and on below button 202 are a pair of laterally-spaced fingers 240 and 242. Projecting a much greater distance below button 202 and individually also extending outward from the respective side walls or skirts 244 and 246 of button 202 are corresponding legs 248 and 250. Respective upper end portions of each of legs 248 and 250 are of smoothly-rounded contour so as to define corresponding hubs 252 and 254.

Button 202, fingers 240 and 242 and legs 248 and 250 all are formed integrally with one another as a one-piece molded assembly. This assembly is made from a material that when molded exhibits an overall surface hardness and rigidity sufficient to maintain shape of the button in use. The material is also sufficiently rigid that, when provided with webs 256 and 258 as illustrated, fingers 240 and 242 are capable of exerting a switch-operating force in directions mutually toward one another. At the same time, however, the molded material is sufficiently flexible and resilient to permit comparatively long and thin legs 248 and 250 to flex laterally and self-restoringly without breaking. A suitable plastic is Acetal, R.M. No. 18553-5.

As best seen in FIG. 31, rocker button 202 is disposed within a well 260 integrally formed during the molding of upper part 230 of the housing. Formed into the bottom wall of lower part 232 of the housing is an upwardly-facing notch 262 disposed at the bottom of each of legs 248 and 250 in a position to seat the very lower end portions of those legs. Formed into the side walls of upper part 230 of the housing are bearings 264 that captivate hubs 252 and 254 when part 230 is placed over rocker button 202 and joined to lower part 232 of the housing.

By means of flanges which are sandwiched between upper and lower housing parts 230 and 232, a double-pole double-throw switch 265 is held in a position centered beneath rocker button 202 situated within well 260. Projecting upwardly from the body of switch 265 is an operator knob 266 which is positioned between fingers 240 and 242. Spaced above the bottom wall of lower portion 232 is a substrate 268 that carries printed wiring to establish connections between the wires 270 within cable 162 and the different electrical contacts 272 which project downwardly from switch 265.

In its central position as shown in FIG. 31, knob 266 of switch 265 is activated to a neutral condition in which no contacts are connected. When the right side of button 202 is depressed, knob 266 is moved to the left so as to connect the left-most pair of contact elements 272 and thereby effect actuation of pump unit 96 for one of its modes of operation as previously described. When button 202 is rocked in the other direction, the right-most pair of the contact elements are connected so as to cause energization of pump unit 96 in the other of its modes of operation mentioned above.

When button 202 is rocked in either direction, legs 248 and 250 bow laterally. Upon the release of pressure urged against surface 238 of the rocker button, legs 248 and 250 resiliently return to their straight conformation and thereby cause button 202 to return to its upright orientation and return knob 266 to its central or neutral position. As can be observed from the drawings, the formation, assembly and operation of rocker button 204 and its associated switch are the same as that which has been described in detail with respect to button 202.

Figure 35:
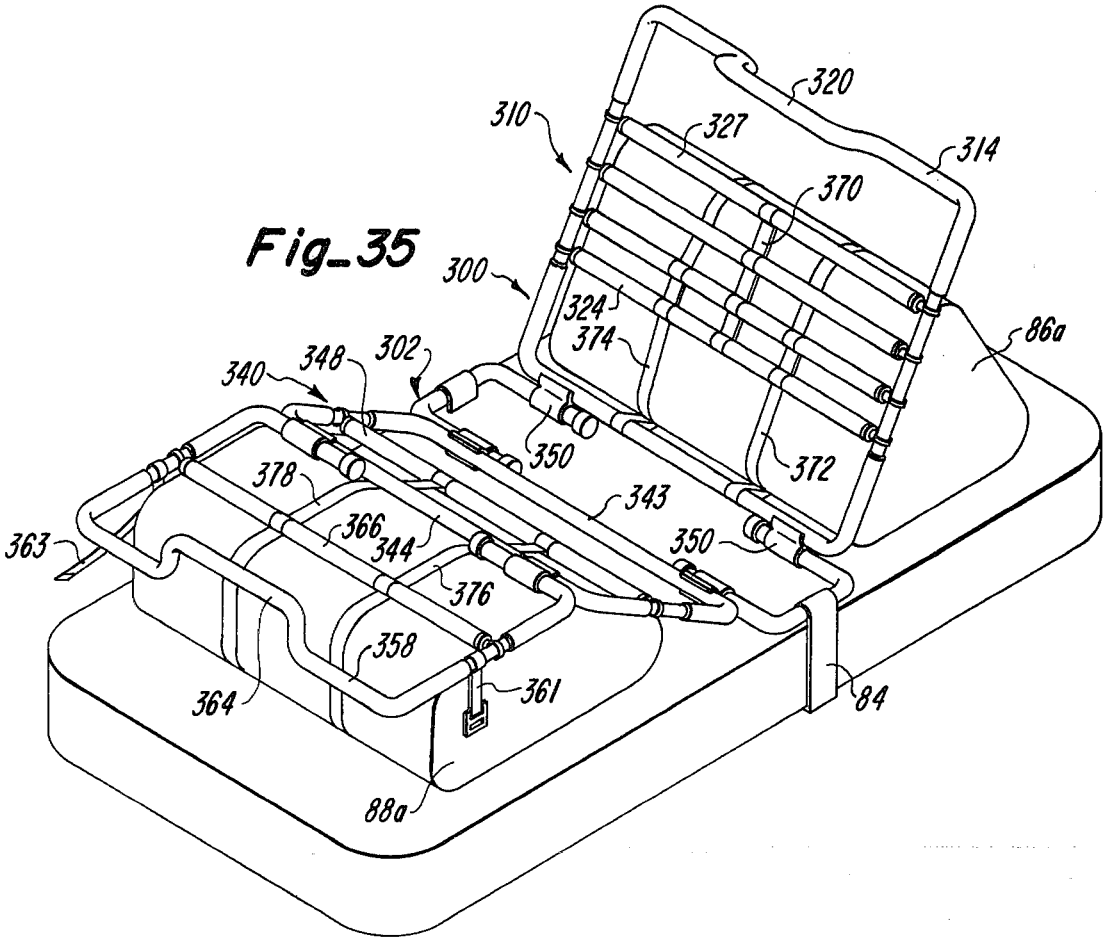
FIG. 35 is an isometric view of an alternative embodiment of portions of a bed assembly.
Figure 40:
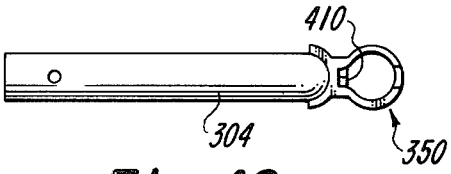
FIG. 40 is a side elevational view of the component of FIGS. 37–39 as assembled to a component shown in FIGS. 35 and 36.
Figure 37:
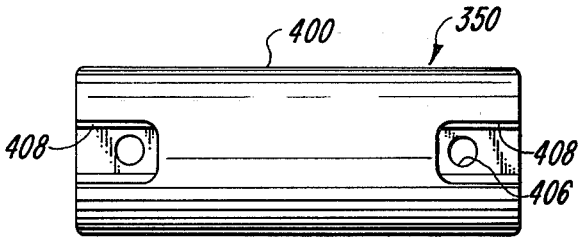
FIG. 37 is a plan view of a component included within that which is shown in FIGS. 35 and 36.
Figure 39:
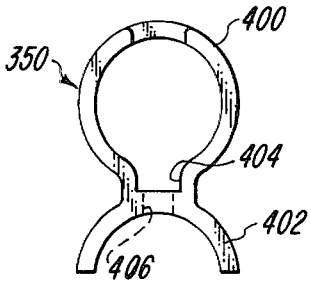
FIG. 39 is an end elevational view of that same component.
Figure 38:
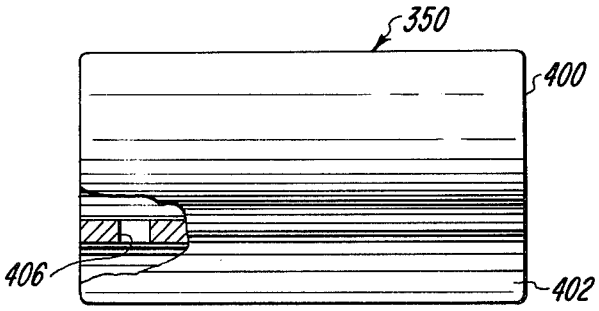
FIG. 38 is a side elevational view of the component of FIG. 37.
Figure 36:
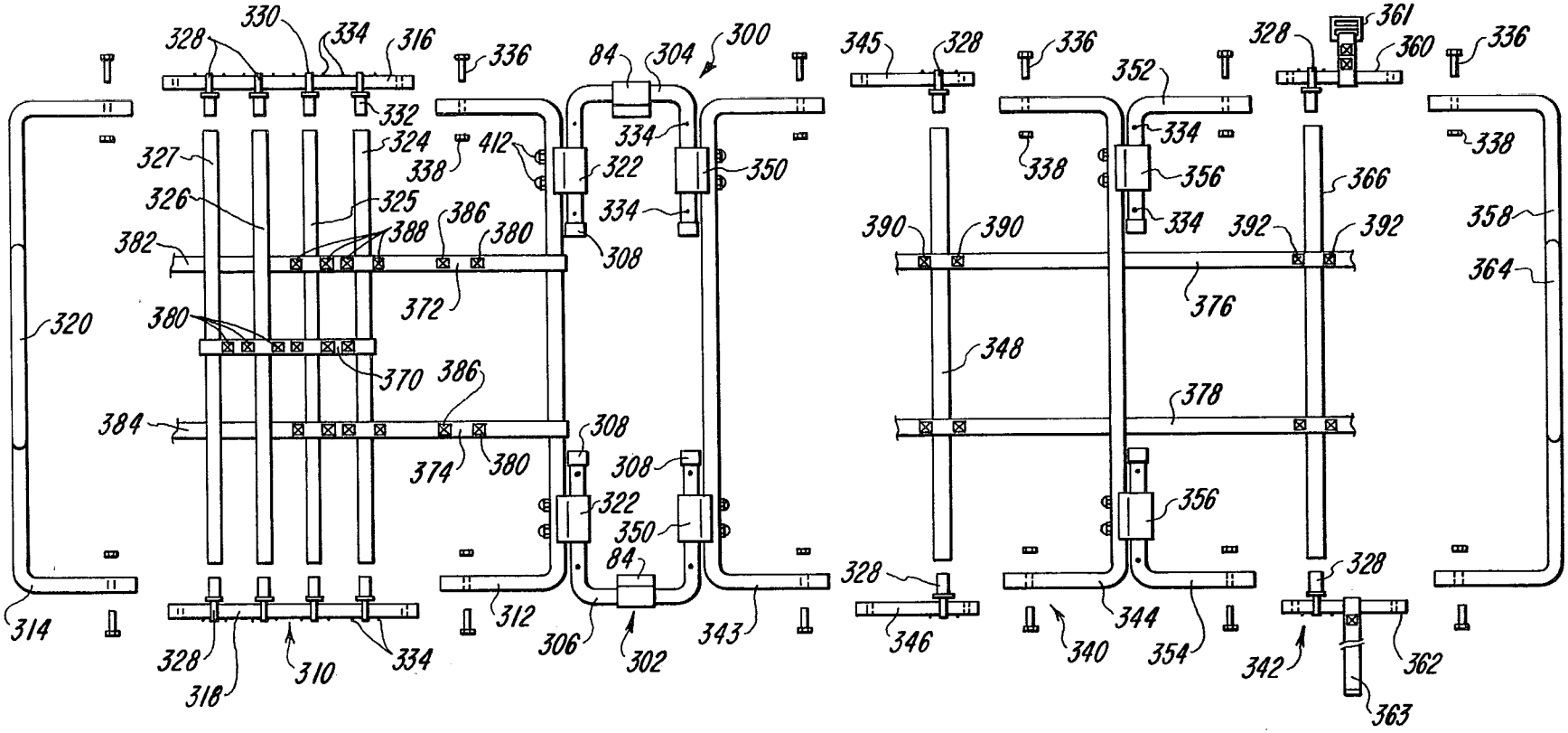
FIG. 36 is a somewhat exploded and partially fragmentary view of a frame assembly incorporated within that which is depicted in FIG. 35.

FIGS. 35 and 36 depict an alternative embodiment that presently is preferred by reason of greater economy of manufacture while yet achieving the primary objectives. As will be seen from FIG. 35, the ultimate manner and capability of operation is basically the same.

In the alternative embodiment, a frame assembly 300 includes a central section 302 formed of facing U-shaped elements 304 and 306, all again preferably being formed from extruded aluminum tubing. The free ends of elements 304 and 306 are closed by plastic caps 308, and L-shaped brackets 84 serve as before to anchor central section 302 to the underlying box spring or other support. For supporting the head end portion of the overlying mattress or pad, a section generally designated 310 is composed of mutually facing U-shaped elements 312 and 314 joined together by elongated elements 316 and 318 at either side. As before, there is an upwardly-deformed central end portion 320 on element 314. Element 312 is hingedly affixed to the adjacent legs of the elements in section 302 by hinges 322 that will be further described hereinafter. A plurality of cross struts 324, 325, 326 and 327 are disposed generally within the central area of section 310 but are mutually spaced apart in the longitudinal direction of the frame so as to define a latticework for support of the overlying mattress or pad. At each end of each one of struts 324–327 is a coupling 328 molded in one piece preferably from a plastic material so as to define a ring 330 having an interior diameter such that it is slidingly receivable upon a corresponding one of elements 316 or 318. Each coupling 328 also includes a fluted dowel 332 that is snugly receivable within a facing end portion of a corresponding one of struts 324–327.

After struts 324–327 together with couplings 328 have been assembled on elements 316 and 318 and arranged as illustrated, self-seating rivets, sheet-metal screws or the like are inserted into the walls of elements 316 and 318 as indicated at 334 so as to confine the location of rings 330 at the desired locations. Additional self-locking or other means of preventing undesired relative movement of the different parts likewise preferably are included elsewhere as also indicated in the different sections by the denomination 334. Upon ultimate assembly, the opposing end portions of elements 316 and 318 are inserted within the corresponding free ends of the legs of elements 312 and 314 and affixed in place by a fastener such as the screws 336 and nuts 338 with the screws being inserted through appropriately-located holes as illustrated.

Proceeding from central section 302 toward the foot end of the overlying mattress or pad, there again are a series of hinged subsections 340 and 342. Subsection 340 is composed of a pair of mutually-facing U-shaped elements 343 and 344 joined together by means of respective spacing elements 345 and 346 with the different elements held together and fastened by means of additional screws 336 and nuts 338. A cross strut 348 is disposed between elements 345 and 346 again by means of couplings 328. Subsection 340 is hingedly affixed to central section 302 by means of hinges 350.

Subsection 342 is in this case composed in part of a space-opposed pair of L-shaped elements 352 and 354 each mounted on one leg by hinges 356 to the adjacent respective portions of the bight of element 344. The other legs of elements 352 and 354 face a U-shaped element 358 to which joinder is made by means of spacing elements 360 and 362 through fastening parts 336 and 338 as hereinbefore described. Also as before, the bight portions of element 358 includes an upwardly-raised central portion 364. Another cross strut 366 is coupled between elements 360 and 362 by means of still additional ones of couplings 328.

Also affixed around element 360 is the buckel end of a strap 361. Similarly affixed to element 362 is an analogous and much longer strap 363. Strap 363 is intended to be brought over one portion of the overlying mattress and pad and, in the manner generally illustrated with regard to straps 80 and 82 as shown in FIG. 1, to be engaged with either the side or center of raised portion 364 so as to confine the lower corners of the mattress pad to the frame.

As depicted, the frame assembly is associated with a plurality of flexible straps 370, 372, 374, 376 and 378. Each strap is composed of woven nylon fibers or the like and at various places is reentrantly bent back upon itself and around different struts so as to enable stitching as is to be explained. Thus, strap 370 is wrapped around the assembly of struts 324–327 after which the upper and lower portions of that strap are stitched adjacent to each internal strut-wall margin as indicated at the locations 380. Such stitching serves to prevent the central portions of struts 324–327 from bowing away from one another as section 310 is utilized to raise and lower the head-end portion of the overlying mattress or pad.

Figure 4:
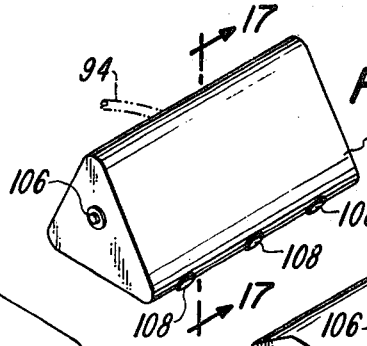
FIG. 4 is an isometric view of a component shown in FIG. 2 but in a condition of changed conformation.

Referring again to FIG. 35, it will be observed that portions of straps 372 entirely encircle an underlying inflatable air bag **86*a*. Bag 86*a* has the same conformation and general construction as bag 86 described above with regard to FIG. 4, except that it does not include any interiorly-located contour-defining elements. Instead, the portions of straps 372 and 374 that encircle bag 86***a* provide the function of defining and limiting the expansion of contour of the bag when it is inflated.

Taking the place of ties 110 of the earlier embodiment are extended segments 376 and 378 respectively of straps 372 and 374 that are wrapped around the bight portion of element 312, returned adjacently and then stitched as indicated at 380. Moreover, straps 372 and 374 extend upwardly of the bed to define respective loops 382 and 384 that encircle bag 86*a* and limit its expansion at their respective locations. Loops 382 and 384 encircle bag 86*a* and ultimately are stitched back to the underlying portion of the strap as at 386. For optimum performance, it has been found best to secure straps 372 and 374 only to struts 324 and 325 as indicated by the stitching 388.

Figure 5:
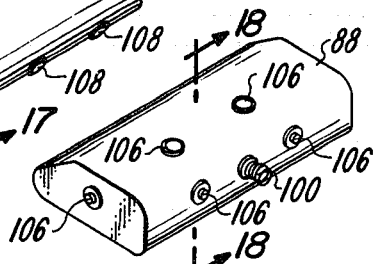
FIG. 5 is also an isometric view of another component shown in FIG. 2 but again of a changed conformation.
Figure 2:
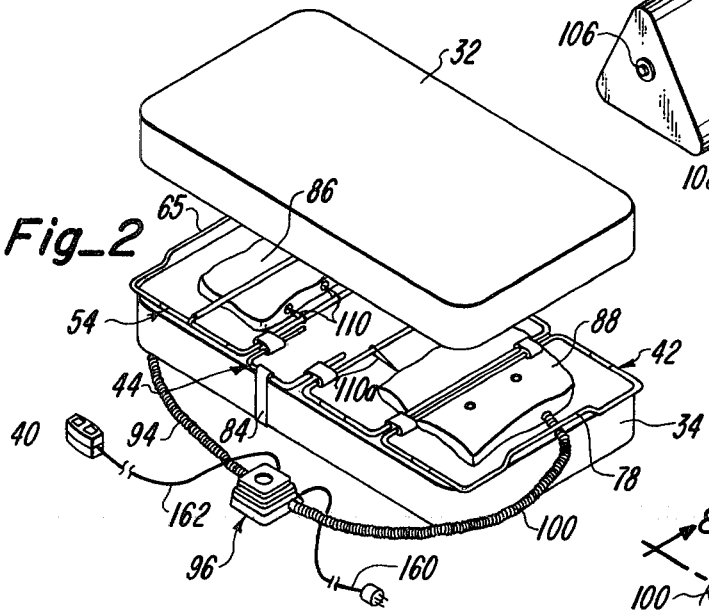
FIG. 2 is a fragmentary exploded isometric view of certain of the components shown in FIG. 1 with various parts being arranged so as to be shown in a different position.

For the foot end of the ultimate bed is another inflatable bag 88*a* which, again, is like bag 88 as shown in FIG. 5 except that it does not include the internal contour-defining elements. Instead, it has been found sufficient to employ straps 376 and 378 to wrap the respective toward-center portions of bag 88*a* with location of the latter being secured with regard to the overall frame assembly only by means of stitching on either side of strut 348 as indicated at 390 and on either side of strut 366 as indicated at 392. Preferably, straps 376 and 378 are not secured directly with respect to element 344.

Hinges 322, 350 and 356 preferably are all alike and constructed as shown in FIGS. 37–40. Moreover, it presently is preferred that these modified hinges be substituted for the hinges 66, 70 and 76 specifically shown in connection with the earlier embodiment. Because the different hinges desirably are the same, only one hinge 350 will be described in detail.

Hinge 350 is in the form of an integrally-molded plastic part that includes a cylinder 400 joined along one side to a semi-cylindrical mount 402. Mount 402 is spaced slightly away from cylinder 400 so as to permit the definition of a well 404 overlying a hole 406 which extends through the portion of the wall of mount 402 adjacent to cylinder 400. A slot 408, oriented on the side of cylinder 400 opposite well 404, extends inwardly from each end of cylinder 400 so as to permit access to the head of a screw 410 inserted into hole 406 and on through suitable openings provided and aligned in the walls of element 312 so as to allow a nut 412 to be engaged upon the screw and thus secure hinge 350 firmly to element 312. At the same time, the hinging leg of element 304 is snugly received within cylinder 400 so as to be constrained but yet hingedly affixed.

As contrasted with the hinges of the earlier embodiment, it will be observed that hinge 350, and thus also hinges 332 and 356, allow hinged rotation only of one of the associated elements. This has been found to be desirable for the purpose of restraining the frame members from undesirably moving relative to one another when the bed is unevently loaded.

In summary, it may be noted that the first-described embodiment, so far as the inflatable air bags and their contour-defining elements are concerned, constitutes that which might be considered as a deluxe, albiet more expensive, version. The later embodiment incorporates an economically more satisfactory system of contour-definition for the inflatable bags and also features an improved construction of the necessary hinges. Nevertheless, different features of the two different basic embodiments may be intermixed as desired in a given situation. Desirably, various series of holes are provided in the legs of the various elements of the frame assembly, so as to accommodate adjustment in length and width of different mattress sizes.

While several embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of that which is patentable.

We claim:

1. For use with a flexible pad which overlies a supporting substrate and includes a feature of flexural adjustability of said pad to a plurality of different positions, the improvement comprising:

an inflatable bag shaped to be positioned between said pad and said substrate;

means for inflating said bag;

at least one elongated flexible element secured with respect to said bag and of a specific length which limits and defines contour of said bag upon inflation thereof;

a frame assembly disposed between said bag and said pad and including a plurality of sections hinged together to permit spatial inclination of one section relative to another;

and means for effectively securing said element to at least one of said sections interiorly of said assembly.

2. Apparatus as defined in claim 1 in which said flexible element is disposed entirely within said bag.

3. Apparatus as defined in claim 1 which further includes a pair of supports individually affixed to space-opposed portions of said bag and respectively secured to corresponding opposite ends of said element.

4. Apparatus as defined in claim 3 which includes a plurality of said flexible elements disposed within said bag with a like plurality of pairs of said supports secured to said element and with each said pair being individually affixed to corresponding different space-opposed portions of said bag as to confine expansion of said portions in the direction of said elements.

5. Apparatus as defined in claim 3 in which said supports are affixed to respective portions of said bag oriented to be disposed adjacent to corresponding lateral margins of said pad.

6. Apparatus as defined in claim 3 in which, when inflated, said bag presents external surface area unengaged with either of said pad and substrate, and in which at least one of said portions is in said area.

7. Apparatus as defined in claim 3 in which one of said supports includes a coupling external to said bag and which further includes means for tying said coupling to said frame assembly.

8. Apparatus as defined in claim 7 in which said coupling is manually detachable from said tying means.

9. Apparatus as defined in claim 7 in which said coupling is pivotally attached to said tying means.

10. Apparatus as defined in claim 7 in which said tying means includes a connector swingably secured on said frame assembly.

11. Apparatus as defined in claim 10 in which said tying means is composed of a shank, a bearing on one end of said shank forming said connector and a trunnion on the other end of said shank and engageable with said coupling.

12. Apparatus as defined in claim 7 in which a plurality of said supports including respective ones of said couplings are distributed successively along one side of said bag in a direction transverse of said pad, and in which a corresponding plurality of said tying means are individually associated with respective different ones of said couplings only on said one side of said bag.

13. Apparatus as defined in claim 3 in which at least one of said supports comprises a first plate sized to overlie an opening in the wall of said bag, a second plate sized to overlie the other side of said opening, and means included in said first and second plates to enable sealing of said plates around the margin of said opening.

14. Apparatus as defined in claim 13 in which one of said plates includes means that defines a coupling to a tying member that connects to said frame assembly.

15. For use with a flexible pad which overlies a supporting substrate and includes a feature of flexural adjustability of said pad to a plurality of different positions, the improvement comprising:

an inflatable bag shaped to be positioned between said pad and said substrate;

means for inflating said bag;

at least one elongated flexible element secured with respect to said bag and of a specific length which limits and defines contour of said bag upon inflation thereof;

a frame assembly disposed between said bag and said pad and including a plurality of sections hinged together to permit spatial inclination of one section relative to another;

a pair of supports individually affixed to space-opposed portions of said bag and respectively secured to corresponding opposite ends of said element;

at least one of said supports comprising a first plate sized to overlie an opening in the wall of said bag, a second plate sized to overlie the other side of said opening, and means included in said first and second plates to enable sealing of said plates around the margin of said opening;

means for effectively securing said bag to at least one of said sections and comprised of:

one of said plates including means that defines a coupling to a tying member that connects to said frame assembly;

and wherein the other of said plates includes means defining an opening that extends through said plate, and in which said one end portion projects through said opening and is secured interally thereof.

16. Apparatus as defined in claim 15 which further includes means defining a hollow nut disposed to encircle the exterior of said opening.

17. For use with a flexible pad which overlies a supporting substrate and includes a feature of flexural adjustability of said pad to a plurality of different positions, the improvement comprising:

an inflatable bag shaped to be positioned between said pad and said substrate;

means for inflating said bag;

at least one elongated flexible element secured with respect to said bag and of a specific length which limits and defines contour of said bag upon inflation thereof;

a frame assembly disposed between said bag and said pad and including a plurality of sections hinged together to permit spatial inclination of one section relative to another;

means for effectively securing said bag to at least one of said sections;

a pair of supports individually affixed to space opposed portions of said bag and respectively secured to corresponding opposite ends of said element;

at least one of said supports comprising a first plate sized to overlie an opening in the wall of said bag, a second plate sized to overlie the other side of said opening, and means included in said first and second plates to enable sealing of said plates around the margin of said opening;

and one of said plates including an internally threaded bore and the other of said plates including an externally threaded stud matable with said bore to enable compression of said plated onto said margin.

18. In combination with a flexible pad which overlies a supporting substrate and includes a feature of flexural adjustability of said pad to a plurality of different positions, the improvement comprising:

an inflatable bag shaped to be positioned between said pad and said substrate;

means for inflating said bag;

at least one elongated flexible element secured with respect to said bag and of a specific length which limits and defines contour of said bag upon inflation thereof;

a frame assembly disposed between said bag and said pad and including a plurality of sections hinged together to permit spatial inclination of one section relative to another;

means for effectively securing said bag to at least one of said sections;

a pair of supports individually affixed to space opposed portions of said bag and respectively secured to corresponding opposite ends of said element;

at least one of said supports comprising a rigid first plate sized to overlie an opening in the wall of said bag, a second rigid plate sized to overlie the other side of said opening and means included in said first and second plates to enable sealing of said plates around the margin of said opening;

and one end portion of said flexible element being secured to one of said plates.

19. For use with a flexible pad which overlies a supporting substrate and includes a feature of flexural adjustability of said pad to a plurality of different positions, the improvement comprising:

an inflatable bag shaped to be positioned between said pad and said substrate;

means for inflating said bag;

at least one elongated flexible element secured with respect to said bag and of a specific length which limits and defines contour of said bag upon inflation thereof;

a frame assembly disposed between said bag and said pad and including a plurality of sections hinged together to permit spatial inclination of one section relative to another;

a pair of supports individually affixed to space-opposed portions of said bag and respectively secured to corresponding opposite ends of said element;

at least one of said supports comprising a first plate sized to overlie an opening in the wall of said bag, a second plate sized to overlie the other side of said opening, and means included in said first and second plates to enable sealing of said plates around the margin of said opening;

means for effectively securing said bag to at least one of said sections and comprised of:

one of said plates including an outwardly projecting hub that defines a cavity internally thereof and a slot in the end wall thereof, and a tying member connectable to said frame assembly, said tying member including a trunnion on one end thereof and insertable through said slot and into a seated position within said cavity across said slot.

20. Apparatus as defined in claim 19 which further includes a plurality of lugs on the wall of said cavity and engageable with said trunnion in confining relationship.

21. Apparatus as defined in claim 1 in which said flexible element is a strap which encircles said bag and is secured to said frame assembly.

22. Apparatus as defined in claim 21 in which said strap is secured to an intermediate portion of each of said sections but is unsecured to the portions thereof which are hinged together.

23. For use with a flexible pad which overlies a supporting substrate and includes a feature of flexural adjustability of said pad to a plurality of different positions, the improvement comprising:

an inflatable bag shaped to be positioned between said pad and said substrate;

means for inflating said bag;

at least one elongated flexible element secured with respect to said bag and of a specific length which limits and defines contour of said bag upon inflation thereof;

a frame assembly disposed between said bag and said pad and including a plurality of sections hinged together to permit spatial inclination of one section relative to another;

means for effectively securing said bag to at least one of said sections;

and said frame assembly including means defining a central section disposable beneath the central region of said pad, a first end section disposable beneath one end region of said pad and hinged to said central section and a second end section disposable beneath the other end region of said pad and also hinged to said central section.

24. Apparatus as defined in claim 23 in which said bag is coupled only along one side thereof to a portion of said frame assembly at the vicinity of hinging between said central section and an end section.

25. Apparatus as defined in claim 24 which includes a second inflatable bag coupled only along one side thereof to another portion of said frame assembly in the vicinity of hinging between said central section and the other of said end sections.

26. Apparatus as defined in claim 25 in which one of said end sections projects rigidly from said central section to the corresponding end of said pad, and the other of said end sections is composed of a pair of mutually hinged subsections together projecting from said central section to the other end of said pad.

27. Apparatus as defined in claim 1 in which said inflating means includes:

a housing;

means defining a vent in said housing for the flow of air between the interior of said housing and the surrounding atmosphere;

a pump in said housing for drawing air from said atmosphere into said housing;

first and second outlets in said housing;

means for coupling said first and second outlets individually to respective different ones of said inflatable bags;

first and second valves disposed individually in respective ones of said outlets;

and control means for selectively opening said first and second valves and for selectively energizing said pump.

28. Apparatus as defined in claim 27 in which said control means enables opening of said valves independently of energizing of said pump, the opening of a valve without energization of said pump allowing deflation of the corresponding one of said bags.

29. Apparatus as defined in claim 1 which includes means for hingedly coupling said sections that comprise a first portion fixed to an element of one section and a second portion securing an element of another section for movement in relative mutual inclination.

30. Apparatus as defined in claim 29 in which said first portion is in the form of a semi-circular element matable to a part of said assembly and is integrally joined by a cylindrical element that encircles another part of said assembly.

31. Apparatus as defined in claim 1 in which said inflating means includes a control unit having a switch assembly, and in which said switch assembly comprises:

a button mounted for rockable depression;

at least one downwardly depending leg secured to said button and resiliently flexural in a horizontal direction;

means for securing the lower end of said leg;

a switch disposed beneath said button and having a switch operator activatable upon horizontal movement thereof;

and means coupling said button to said operator for activating said switch upon rocking movement of said button.

32. Apparatus as defined in claim 31 in which said leg and said coupling means are integrally formed along with said button.

* * * * *